United States Patent [19]

McKee

[11] Patent Number: 4,870,907

[45] Date of Patent: Oct. 3, 1989

[54] TOWEL RACK CONVENIENCE SHELF

[76] Inventor: Roy L. McKee, 1610 Melrose Cir., Garland, Tex. 75042

[21] Appl. No.: 229,968

[22] Filed: Aug. 9, 1988

[51] Int. Cl.[4] ..... A47B 23/00

[52] U.S. Cl. ..... 108/42; 211/90; 248/214

[58] Field of Search ..... 108/42, 47, 90, 28, 108/29, 16, 30, 46, 40; 248/214, 235; 211/88, 90

[56] References Cited

U.S. PATENT DOCUMENTS

| | | | |
|---|---|---|---|
| 1,513,440 | 10/1924 | Wirt | 108/48 X |
| 1,739,263 | 12/1929 | Sayers | 108/28 |
| 3,096,731 | 7/1963 | Lehman | 108/29 |
| 3,233,744 | 2/1966 | Ripps | 248/214 X |
| 4,181,382 | 1/1980 | Harvey | 248/214 X |
| 4,577,751 | 3/1986 | St-Jacques | 211/90 X |

FOREIGN PATENT DOCUMENTS

| | | | |
|---|---|---|---|
| 1580482 | 9/1909 | France | 108/42 |

*Primary Examiner*—Kenneth J. Dorner
*Assistant Examiner*—José V. Chen
*Attorney, Agent, or Firm*—Warren H. Kintzinger

[57] ABSTRACT

A shelf that can be installed on various length existing towel bars using double-sided adhesive tape. The shelf is a convenience item that will not interfere with the original use of a towel bar with opposite side mounting brackets fastened to the underside of the shelf with double-sided adhesive tape supporting the shelf well above the towel bar. The shelf element itself has a rear flange that is fastened to a wall with double-sided adhesive tape to further securely mount the shelf in place above a towel bar. Bracket triangular knock-outs are provided for adaption to mounting on top pointed towel bars.

3 Claims, 1 Drawing Sheet

TOWEL RACK CONVENIENCE SHELF

Figure 1:
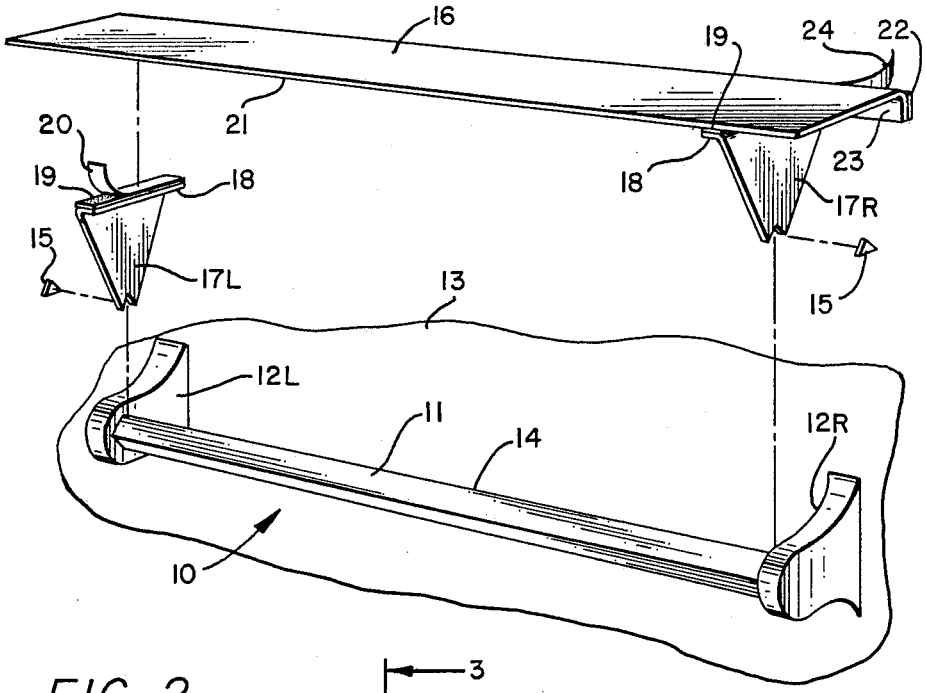

This invention relates in general to shelving in bathrooms, and more particularly, to a towel rack and wall mounted convenience shelf with the shelf mounted on and above an existing wall mounted towel bar.

The bathroom environment is such that in many instances additional shelving would be a great convenience particularly where several people use the same bathroom. Many times one persons towels(s) and wash cloths(s) would be on a specific personal towel rack so that it would be convenient to have a shelf mounted above the personal towel rack for personal items of the same person. Where a towel rack is provided above a bathtub or in a shower stall a shelf mounted there-above would be quite handy for carrying bath items within easy reach of the bather.

It is therefore a principal object of this invention to provide a towel rack convenience shelf mounted on a towel bar and to the wall above the wall mounted towel bar.

Another object is to provide such a towel rack and wall mounted convenience shelf that is easy to assemble and mount in place.

A further object is to provide such a shelf that can be installed on various length existing towel bars.

Still another object is to provide such a shelf adaptable for mounting on the flat top or pointed top of a towel bar depending on bar rotational orientation.

Features of the invention useful in accomplishing the above objects include, in a towel rack and bar and wall mounted convenience shelf, a shelf that can be installed on various length existing towel bars and on the wall a towel bar is mounted on using doubled-sided adhesive tape. The shelf is a convenience item that will not interfere with the original use of a towel bar with opposite side mounting brackets fastened to the underside of the shelf with double-sided adhesive tape to further securely mount the shelf in place above a towel bar. Bracket triangular knock-outs are provided for adoption to mounting on top pointed towel bars with a square bar rotated forty five degrees from the top surface horizontal state.

A specific embodiment representing what is presently regarded as the best mode of carrying out the invention is illustrated in the accompanying drawing.

Figure 2:
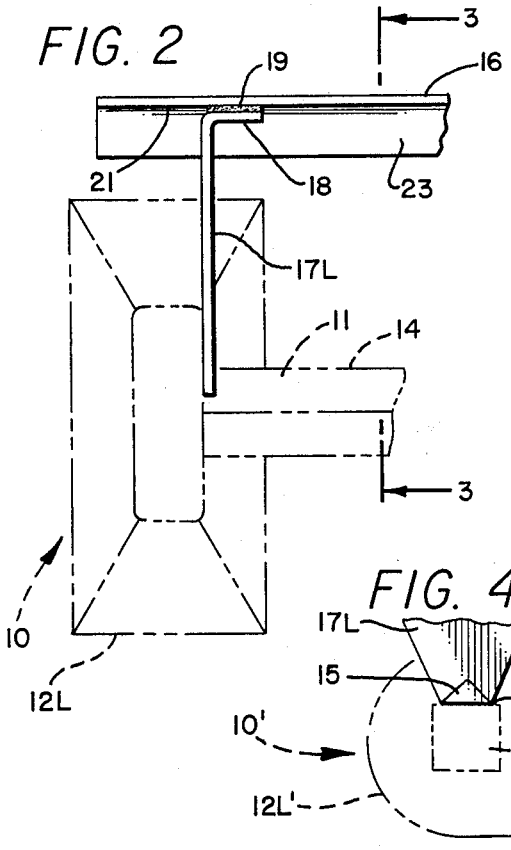
Figure 3:
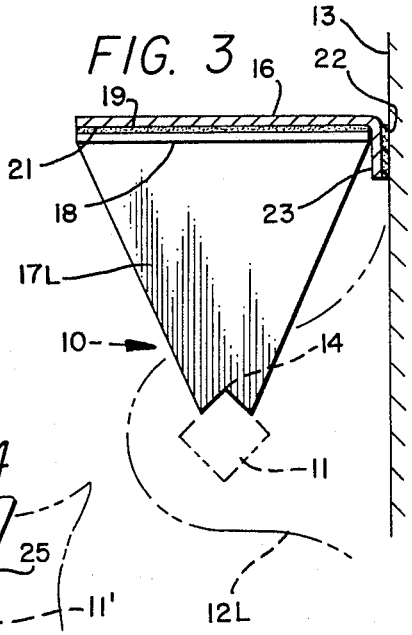
Figure 4:
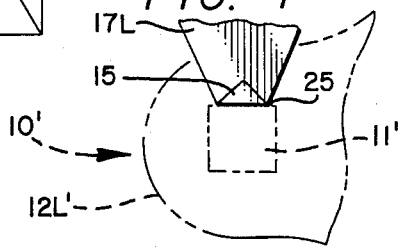

In the drawing:

FIG. 1 represents a partially exploded perspective view of a towel rack and convenience shelf mountable on the towel bar of the towel rack and on the wall the towel rack is mounted on;

FIG. 2, a partially cut-away front elevation view of the convenience shelf as mounted on a towel rack;

FIG. 3, a side elevation cut-away view taken from line 3—3 of FIG. 2 showing a shelf bracket mounting with a cut-out removed resting on the peak of a forty five degree rotated towel bar; and, FIG. 4, a partial side elevation view of a shelf bracket with the cut-out still in place resting on the flat horizontal top of a non-rotated towel bar.

Referring to the drawing:

The towel rack 10 of FIGS. 1–3 is shown to have a towel bar 11 interconnecting opposite end towel bar mounting brackets 12L and 12R that are mounted on a wall 13. In the towel rack 10 the towel bar 11 is rotated forty five degrees so that there is a corner 14 pointed upward that is accomodated by triangular knock-outs

15 in opposite end shelf 16 mounting brackets 17L and 17R. These brackets 17 are duplicates one of the other except that they are reversed with shelf mounting flanges 18 extended toward each other at the top of the brackets 17 although they would not have to be reversed. The shelf 16 mounting flanges 18 each mount a strip of double-sided adhesive faced tape 19 that adheres to the top of each flange 18 and that when a facing strip 20 is pulled away adheres to the bottom 21 of shelf 16 when pressed together. The tapes 19 may be double-sided foam adhesive tape just the same as may be the tape 22 on the back of shelf back flange 23 that when facing strip 24 is pulled away adheres to the wall 13 when pressed there against. The shelf 16 mounting brackets 17L and 17R are generally triangular in shape from the flange 18 top to the knock-out 15 apex bottom and while shelf 16 may remain a pre-selected length the brackets 17 L and 17R may be fastened to the bottom of the shelf 16 with various spacings to fit within and adjacent to the inner sides of towel bar mounting brackets 12L and 12R in adjusting to different length towel racks 10.

Referring now to FIG. 4, a towel rack 10' is shown with the towel bar 11', square in cross section, is mounted with a flat side 25 horizontal on the top. With this approach the knowk-outs 15 are left in place in the opposite side brackets 17L and 17R for proper support on the top 25 of towel bar 11'.

Whereas this invention has been described with respect to several embodiments thereof, it should be realized that various changes may be made without departing from the essential contributions to the art made by the teachings hereof.

I claim:

1. A towel rack mountable convenience shelf comprising: a transversally extended shelf element mountable above a wall mounted towel rack; vertically downward extending brackets with first fastening means on the top of each for being fastened to said shelf element and having bottoms adapted for engaging and resting on a towel bar of said towel rack inboard of opposite end towel rack mounting brackets; mounting flange means at the wall engaging side of said transversally extended shelf element; and second fastening means for fastening of said shelf element to said wall mounting of said towel rack; wherein said first fastening means on the top of each vertically downward extending bracket is double-sided adhesive faced tape positioned on a top flange of each of said vertically downward extending brackets whereby said brackets are fastened to the bottom of the shelf with various spacings to fit within and adjacent to the inner sides of towel bar mounting brackets in being adapted to different length towel racks; said double-sided adhesive faced tape has a pull away facing strip that upon being pulled away, the vertically downward extending brackets are pressed against the bottom of said shelf element; said flange means at the rear of said transversally extended shelf element is at right angles to an article supporting shelf of said shelf element; said second fastening means for fastening of said shelf element to the wall mounting said towel rack is double-sided adhesive faced tape positioned on said flange means; said double-sided adhesive faced tape positioned on said flange means has a pull away facing strip that upon being pulled away, said shelf element is pressed against the wall for fastening of the shelf element to the wall; wherein said shelf element mounting brackets are triangular in shape from a broad flange top narrowing down to a truncated relatively narrow bottom; said bracket truncated relatively narrow bottoms have triangular knock-outs that are removable for the bracket bottoms to receive the top upward corner of a towel bar rotated forty five degrees, from a top surface horizontal state, that the shelf brackets are mounted on.

2. The towel rack mountable convenience shelf of claim 1, wherein said double-sided adhesive faced tape on both the shelf element and on the brackets is double-sided foam adhesive faced tape.

3. The towel rack mountable convenience shelf of claim 1, wherein said bracket truncated relatively narrow bottoms are flat to rest on the flat horizontal top of a square in cross section towel bar so mounted in a towel rack.

* * * * *